US006923027B1

(12) United States Patent
Kuo

(10) Patent No.: US 6,923,027 B1
(45) Date of Patent: Aug. 2, 2005

(54) CABLE LOCK ASSEMBLY TO ENSURE STABLE LINEAR MOVEMENT OF THE LATCH BOLT

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 10/868,779

(22) Filed: Jun. 17, 2004

(51) Int. Cl.[7] ..... E05B 67/06
(52) U.S. Cl. ..... 70/49; 70/58; 70/233
(58) Field of Search ..... 70/14, 18, 30, 70/49, 58, 32, 34, 42, 43, 388, 39, 233, DIG. 42

(56) References Cited

U.S. PATENT DOCUMENTS 1,005,852 A * 10/1911 Lewis ..... 70/43
1,350,392 A * 8/1920 Taylor ..... 70/43
1,520,902 A * 12/1924 Junkunc ..... 70/49
5,253,496 A * 10/1993 Wang ..... 70/38 R
5,331,830 A * 7/1994 Su ..... 70/38 A
5,511,400 A * 4/1996 Ma ..... 70/38 R
6,055,833 A * 5/2000 Ding-Chiang ..... 70/39

* cited by examiner

*Primary Examiner*—Lloyd A. Gall
(74) *Attorney, Agent, or Firm*—Dennison, Schultz, Dougherty & MacDonald

(57) ABSTRACT

A lock assembly includes a casing containing a cylinder assembly, a rotary bolt driver and a shank inside the casing. The rotary bolt driver has a crossbar to selectively abut two stop blocks formed on a latching disk. Thus the rotational movement of the rotary bolt driver is able to move the latching disk inside the longitudinal chamber so as to secure the shank inside the casing.

20 Claims, 9 Drawing Sheets

CABLE LOCK ASSEMBLY TO ENSURE STABLE LINEAR MOVEMENT OF THE LATCH BOLT

BACKGROUND OF THE INVENTION

1. Field of the Invention

The present invention relates to a lock assembly, and more particularly to a lock assembly for a bicycle or the like to ensure smooth linear movement of the latch bolt.

2. Description of Related Art

With reference to FIGS. 8 and 9, a conventional lock assembly comprises a casing (60), a cylinder assembly (50) and a shank (70). The cylinder assembly (50) is mounted inside the casing (60). The shank (70) is partially inserted into the casing (60) and is held in the casing (60) by the cylinder assembly (50).

The casing (60) is cylindrical and has a distal end (not numbered), a cylinder chamber (61) and a shank chamber (62). The cylinder chamber (61) is formed longitudinally in the distal end of the casing (60) and has an open outside end (not numbered), an inside end (not numbered) and a bolt hole (63). The bolt hole (63) is formed through the inside end of the cylinder chamber (61). The shank chamber (62) is formed diametrically in the casing (60) near the inside end of the cylinder chamber (61), communicates with the bolt hole (63) in the cylinder chamber (61) and has an open outside end (not numbered) and an inside end (not numbered).

The cylinder assembly (50) is mounted securely inside the cylinder chamber (61) and has a cylinder (51), a plug (not shown), a bolt driver (52), a bolt (53) and a spring (55). The cylinder (51) is mounted in the open outside end of the cylinder chamber (61). The plug has an inside end (not shown), an outside end (not shown) and a keyhole (not shown) and is rotatably mounted inside the cylinder (51). The keyhole is formed axially through the outside end of the plug. The bolt driver (52) is cylindrical, is attached to the inside end of the plug and has a push pin (521) formed radially through and extending from the bolt driver (52). The bolt (53) is cylindrical and has an internal cavity (not numbered), an outer surface (not numbered), an open end (not numbered), a closed end (not numbered), a flange (531) and a spiral groove (54). The internal cavity is formed longitudinally through the open end of the bolt (53). The flange (531) is formed on the outer surface at the open end of the bolt (53) and extends radially from the outer surface. The spiral groove (54) is formed through the outer surface of the bolt (53) from the open end and communicates with the internal cavity. The internal cavity and open end of the bolt (53) are mounted slidably on the bolt driver (52) with the push pin (521) slidably mounted in the spiral groove (54). The spring (55) is mounted around the bolt (53) between the flange (531) and the inside end of the cylinder chamber (61) to provide a restitution force to the bolt (53). When the lock assembly is unlocked, the closed end of the bolt (53) is positioned in the bolt hole (63), and the open end and the flange (531) are held against the inside end of the plug by the spring (55).

The shank (70) is cylindrical and has a distal end, a head (not numbered), a radial recess (71) and a neck (not numbered). The head is formed on the distal end of the shank (70). The neck forms the radial recess (71) around the shank (70). When the shank (70) is inserted into the shank chamber (62) through the open end of the shank chamber (62), the radial recess (71) aligns with the bolt hole (63).

The lock assembly is operated by inserting the shank (70) fully into the shank chamber (62), inserting a key (80) into the keyhole and rotating the key to rotate the plug, which rotates the bolt driver (52) and the push pin (521) about 90°. When the push pin (521) rotates and moves in the spiral groove (54), a force is generated to push closed end of the bolt (53) into the shank chamber (62) and the radial recess (71) around the shank (70). Thereby, the lock assembly is locked.

However, friction between the push pin (521) and the spiral groove (54) causes the push pin (521) and the spiral groove (54) to wear. Specifically, the push pin (521) wears down and eventually shears off causing the lock assembly to fail. Uneven wear of the spiral groove (54) causes the lock assembly to operate erratically. Therefore, the conventional lock assembly is neither reliable nor durable and these problems can lead to considerable frustration where a user is unable to unlock the locked item.

The present invention has arisen to mitigate or obviate the disadvantages of the conventional lock assembly.

SUMMARY OF THE INVENTION

The main objective of the present invention is to provide a lock assembly that is durable and reliable.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
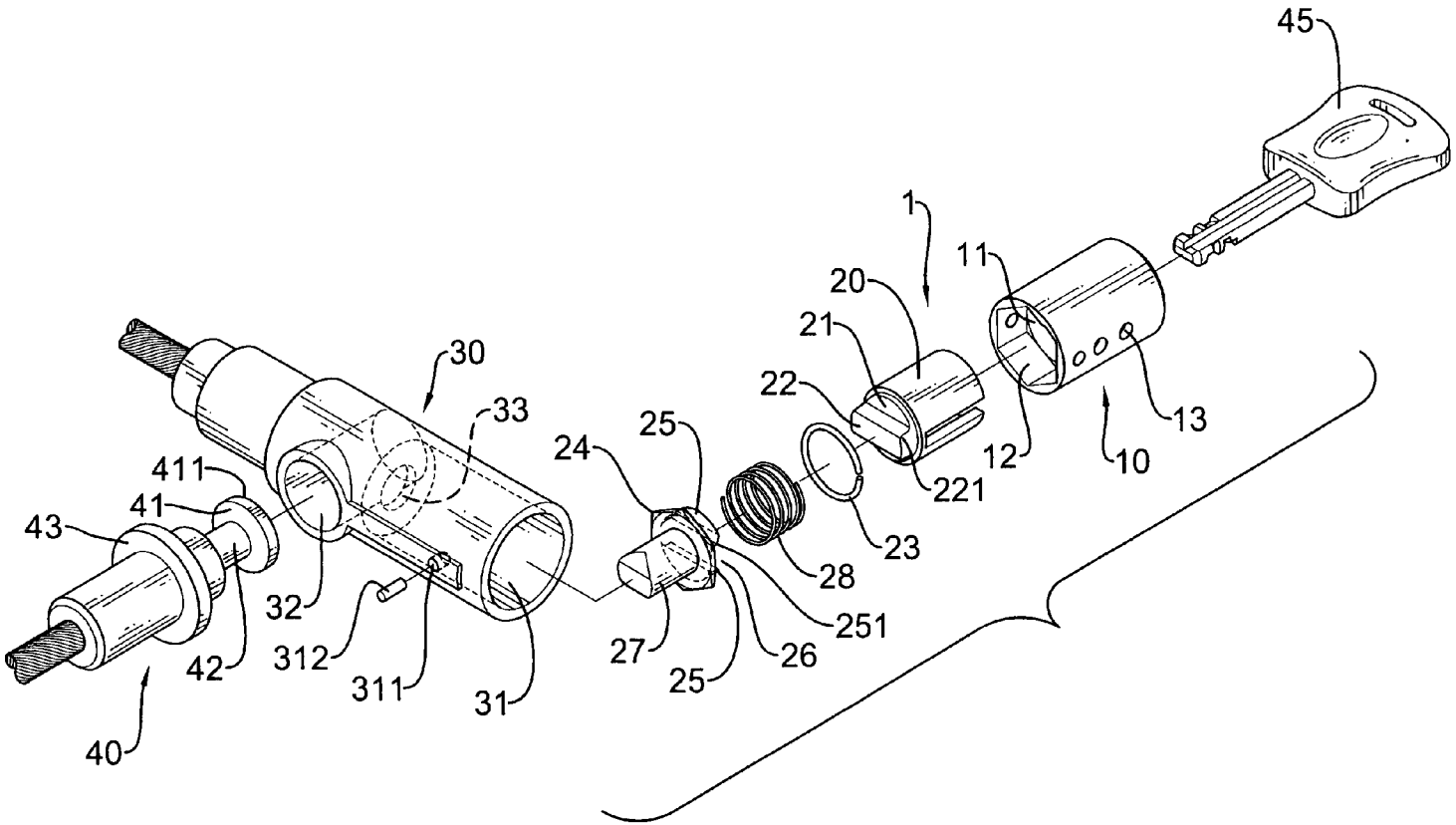
FIG. 1 is an exploded perspective view of a lock assembly in accordance with the present invention.

With reference to FIG. 1, a first embodiment of a lock assembly (1) in accordance with the present invention comprises a casing (30), a cylinder assembly (10), a rotary bolt driver (20) and a shank (40).

The casing (30) is cylindrical and has a longitudinal chamber (31), a locking-pin hole (311), a locking pin (312) and a transverse chamber (32). The longitudinal chamber (31) is formed at the distal end of the casing (30) and has an open end as an access (not numbered) for receiving therein the rotary bolt driver (20) and the cylinder assembly (10), and a bolt hole (33). The locking-pin hole (311) is defined radially through the outer surface of the casing (30) and in the sidewall of the longitudinal chamber (31). The bolt hole (33) is formed through the inside end of the longitudinal chamber (31). The transverse chamber (32) is formed in the casing (30) perpendicular to the longitudinal chamber (31) and near the inside end of the longitudinal chamber (31) to communicate with the bolt hole (33) and has an open outside end as an access (not numbered) for selectively receiving therein the shank (40) and an inside end (not numbered).

The cylinder assembly (10) is mounted securely inside the longitudinal chamber (31) and comprises a cylindrical space (11) inside the cylinder assembly (10) and an open end (12) in communication with the cylindrical space (11). Pinholes (13) are defined radially in the outside surface of the cylinder (11) to correspond to and align with the locking-pin hole (311) through the casing (30) when cylinder assembly (10) is received in the longitudinal chamber (31), and an outer end of the cylinder assembly (10) is flush with the distal end of the casing (30). The locking pin (312) is extended through the locking-pin hole (311) in the casing (30) and into a respective one of the pinholes (13) to hold the cylinder assembly (10) securely in the longitudinal chamber (31).

The rotary bolt driver (20) is rotatably received inside the cylindrical space (11) of the cylinder assembly (10) and has an end face (21) formed on a distal end of the rotary bolt driver (20), a crossbar (22) formed on the end face (21) and having arcuate sides (221) formed on opposite sides of the crossbar (22) and a C-clip (23) securely received in the cylindrical space (11) to prevent escape of the rotary bolt driver (20) out of the cylinder assembly (10).

Furthermore, a latching disk (24) is immovably received in the cylindrical space (11) of the cylinder assembly (10). The latching disk (24) has two stop blocks (25) formed on a side of the latching disk (24) with each stop block (25) having truncated sides (251) oppositely formed on two sides of the stop block (25) to correspond to the arcuate sides (221) of the crossbar (22), a passage (26) defined between the stop blocks (25) to correspond to and alternatively receive therein the crossbar (22), and a latch bolt (27) extending from the other side of the latching disk (24).

The shank (40) is cylindrical and has a distal end, a head (41), a recessed neck (42) and a block disk (43) formed on the shank (40) to sandwich the recessed neck (42) with the head (41). The head (41) is formed on the distal end of the shank (40) and has smoothly formed arcuate face (411) formed on an outer side face of the head (41). When the shank (40) is inserted into the transverse chamber (32) through the open end of the transverse chamber (32), the recessed neck (42) aligns with the bolt hole (33).

Figure 2:
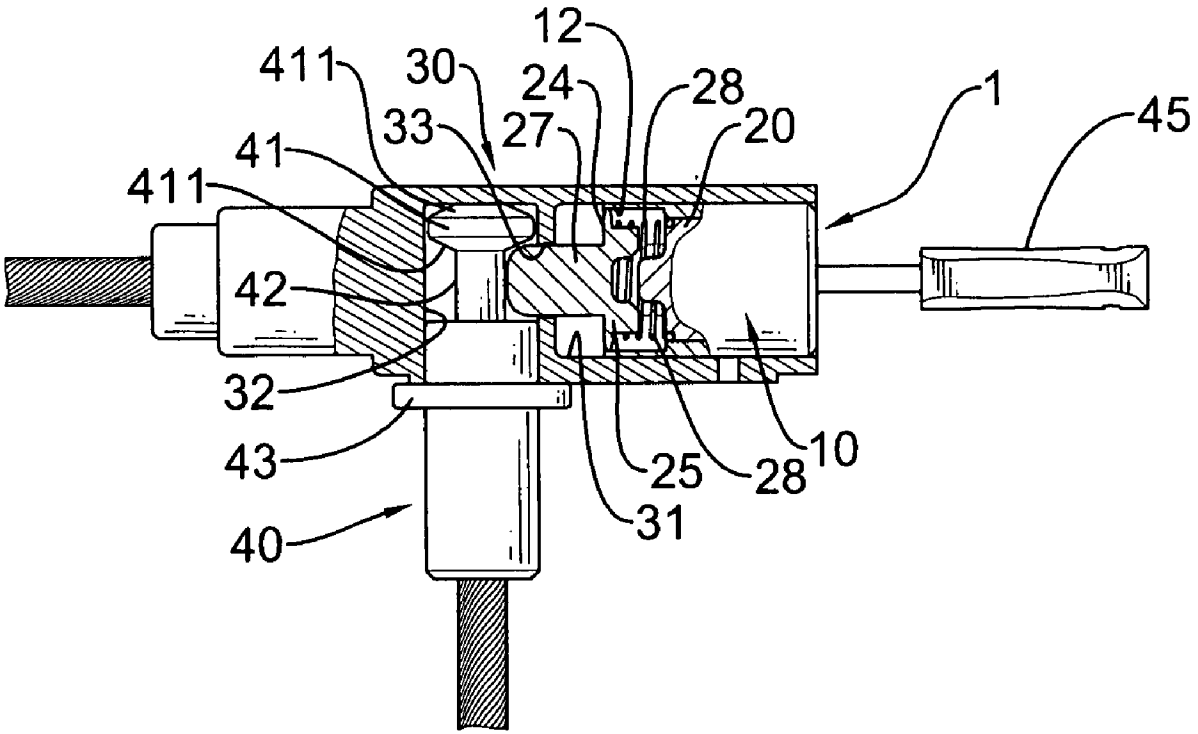
FIG. 2 is a side plan view in partial section of the lock assembly in FIG. 1 with the lock assembly unlocked.
Figure 3:
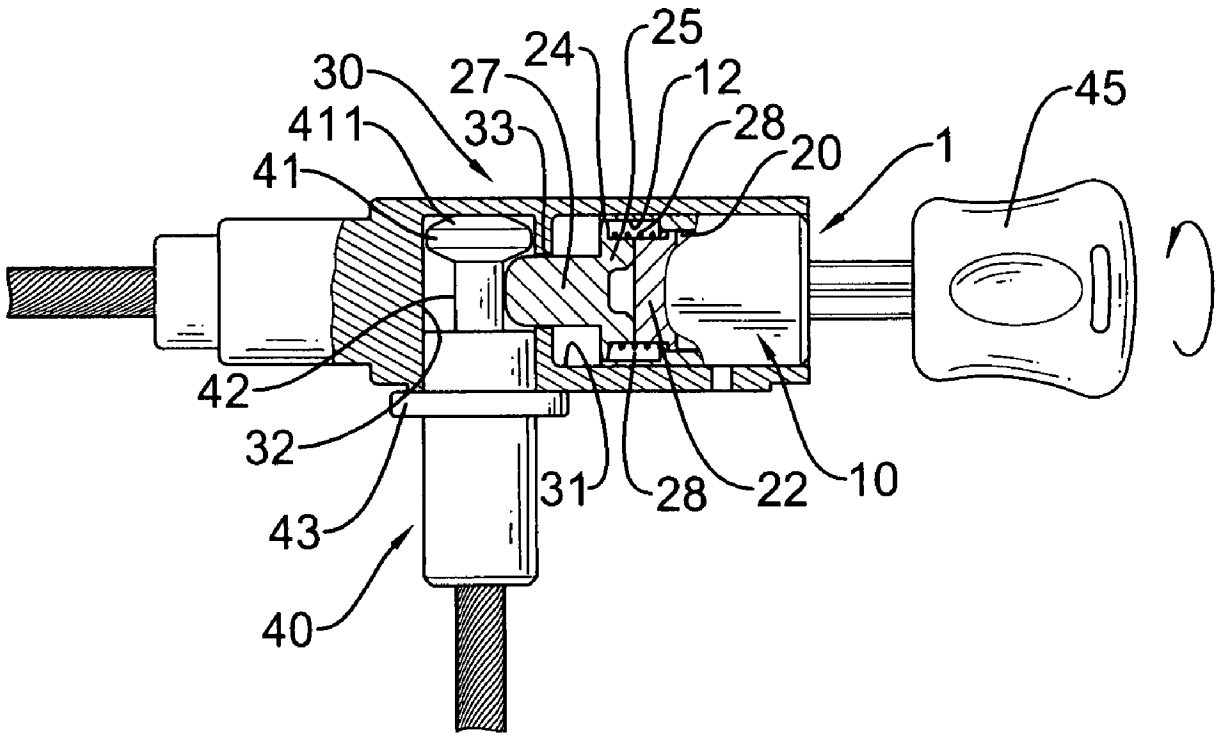
FIG. 3 is a side plan view in partial section of the lock assembly in FIG. 1 with the lock assembly locked.

With reference to FIGS. 2 and 3, when the lock assembly (1) of the present invention is assembled, it is noted that after the rotary bolt driver (20) is limited by the C-clip (23) inside the cylindrical space (11) of the cylinder assembly (10), a spring (28) is sandwiched and mounted between the end face (21) of the rotary bolt driver (20) and the stop blocks (25) of the latching disk (24) which is movably received in the cylindrical space (11) with the latch bolt (27) extending out of the open end (12) of the cylinder assembly (10) and into the bolt hole (33) of the casing (30).

It is to be noted that the open end (12) of the cylinder assembly (10) and an outer periphery of the latching disk (24) are so configured that after the latching disk (24) is received inside the cylindrical space (11) of the cylinder assembly (10), there is no relative rotational movement between the cylinder assembly (10) and the latching disk (24). That is, if the open end (12) of the cylinder assembly (10) is hexagonal, the outer periphery of the latching disk (24) is hexagonal with a slightly smaller dimension than that of the open end (12) such that after the latching disk (24) is received in the cylindrical space (11), the latching disk (24) can only have linear movement inside the cylindrical space (11) relative to the cylinder assembly (10). Obviously, other configurations to accomplish the same purpose may be adopted and the aforementioned embodiment is not designed to limit the scope of the invention.

After the assembly of the lock assembly (1), the head (41) of the shank (40) is inserted into the transverse chamber (32) to have the recessed neck (42) aligned with the bolt hole (33). However, when the head (41) is inserted into the transverse chamber (32), the arcuate face (411) of the head (41) forces the latch bolt (27) to move further inside the cylindrical space (11) of the cylinder assembly (10). Then after the head (41) reaches the distal end face defining the transverse chamber (32) to have the recessed neck (42) aligned with the bolt hole (33), the latch bolt (27) springs back and its distal end is received in the recessed neck (42) of the shank (40). In the meantime, the crossbar (22) is received in the passage (26). However, after the rotary bolt driver (20) is rotated by the key (45), due to the interrelationship between the truncated sides (251) and the arcuate sides (221), the crossbar (22) escapes from the passage (26) and abuts free ends of the stop blocks (25). Because the configuration limitation to the latching disk (24) is to prevent rotational movement of the latching disk (24) relative to the cylinder assembly (10) as well as the rotary bolt driver (20), the rotational movement of the rotary bolt driver (20) to have the crossbar (22) to abut the free ends of the stop blocks (25) drives the latching disk (24) to move linearly inside the longitudinal chamber (31), which eventually secures the shank (40) inside the transverse chamber (32) after the key (45) is removed.

Figure 4:
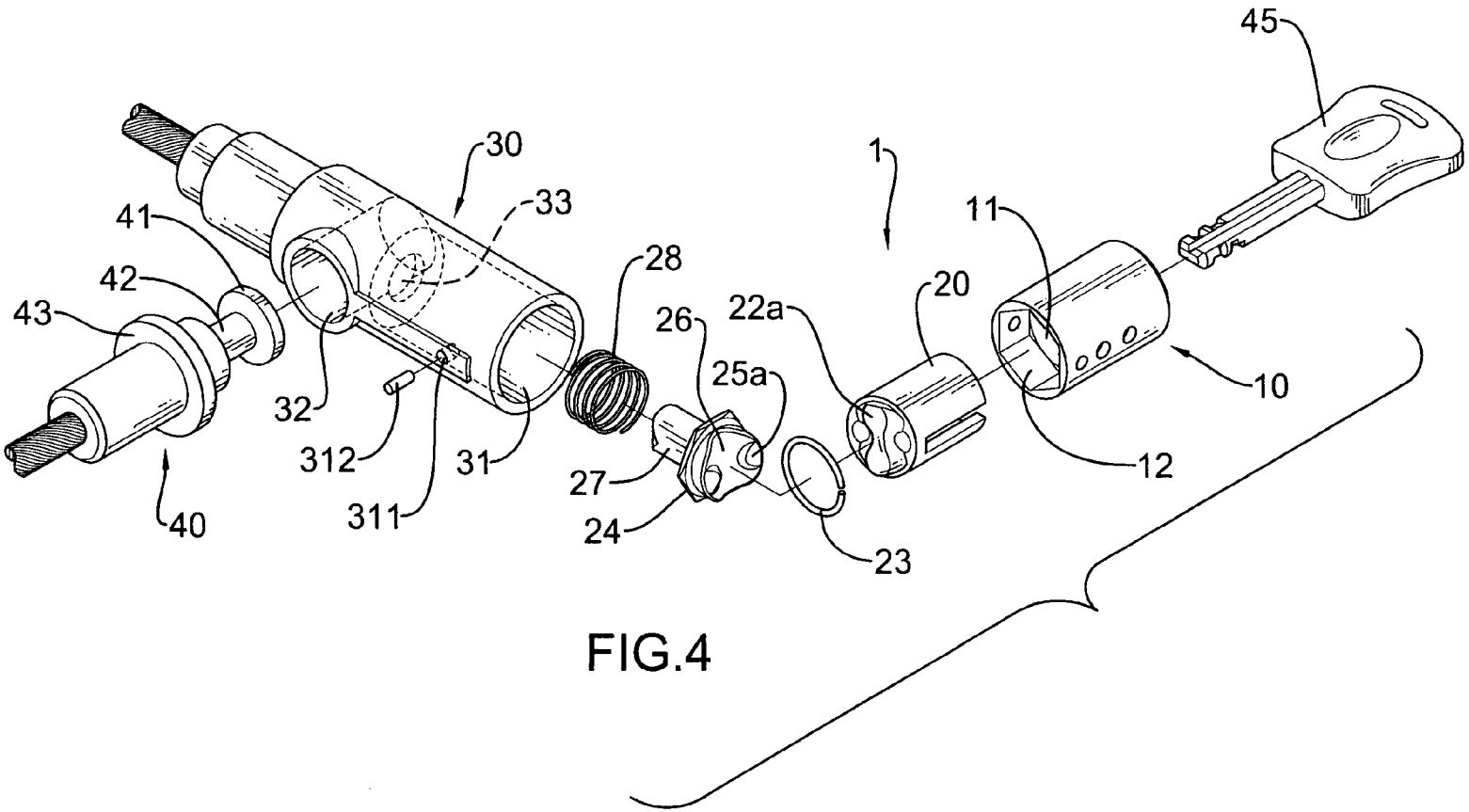
FIG. 4 is an exploded perspective view of a lock assembly of a different embodiment of the present invention.
Figure 5:
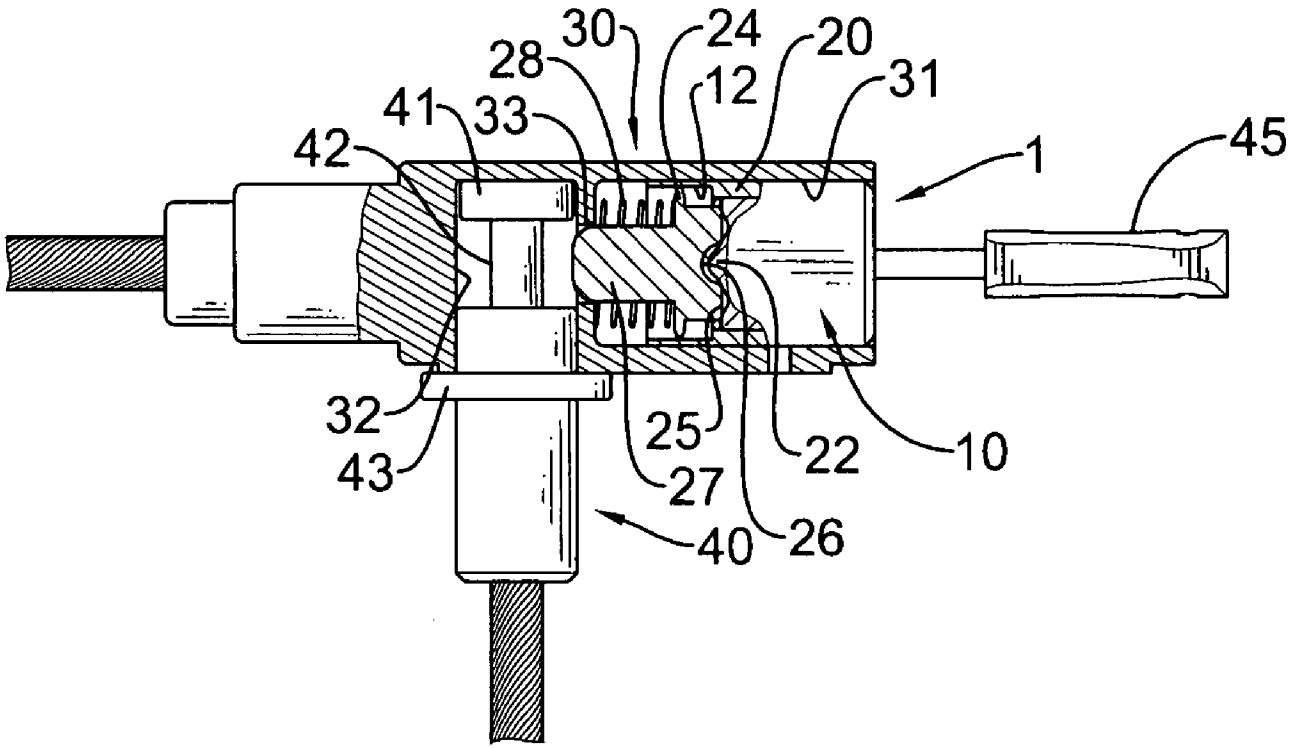
FIG. 5 is a side plan view in partial section of the lock assembly in FIG. 4 with the lock assembly unlocked.
Figure 6:
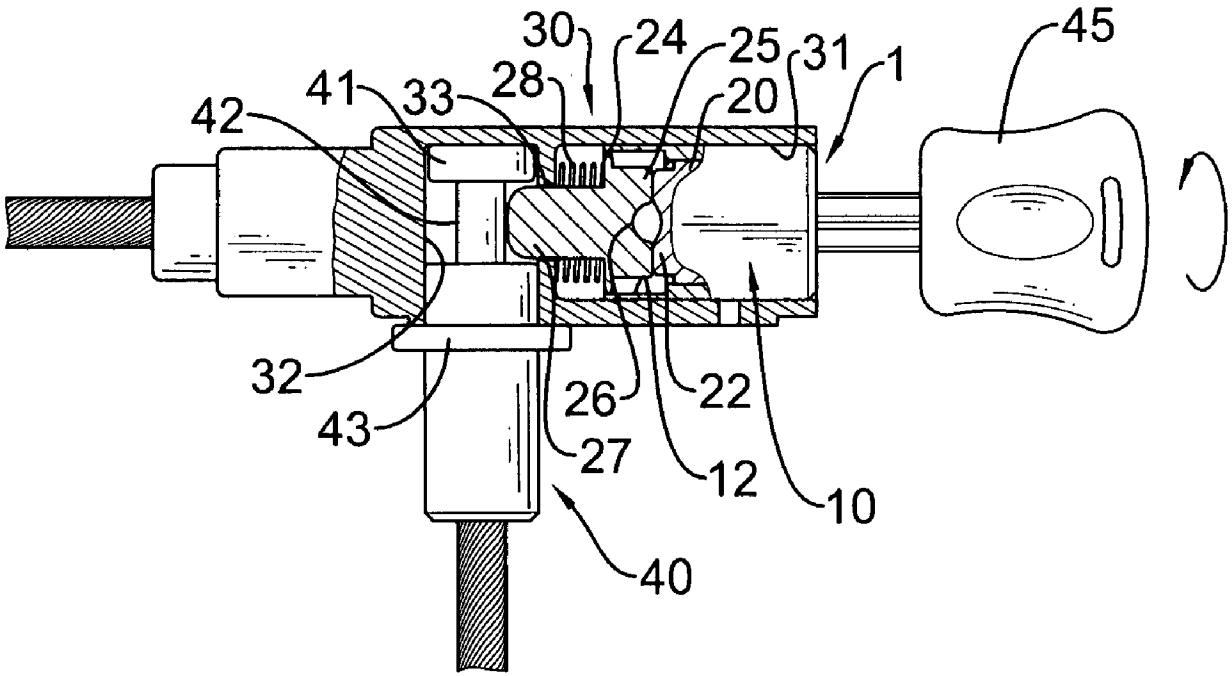
FIG. 6 is a side plan view in partial section of the lock assembly in FIG. 4 with the lock assembly locked.

With reference to FIGS. 4, 5 and 6, it is noted that the configuration relationships among elements are almost the same as those described earlier. The only difference is that the stop blocks (25) of the latching disk (24) are two bosses (25*a*) and the crossbar (22) in the first embodiment of the present invention is changed to become two protrusions (22*a*). Thus when the two protrusions (22*a*) abut free ends of the two bosses (25*a*), the latch bolt (27) is forced to move inside the longitudinal chamber (31) to secure the shank (40) in the casing (30). Furthermore, the spring (28) is mounted around the latch bolt (27) and sandwiched between the latching disk (24) and a bottom face defining the longitudinal chamber (31) to maintain the latch bolt (27) of the latching disk (24) away from the recessed neck (42). However, after the latching disk (24) is forced to move by the rotation of the rotary bolt driver (20), the latch bolt (27) is received in the recessed neck (42) of the shank (40) to secure the shank (40) inside the casing (30).

Figure 7:
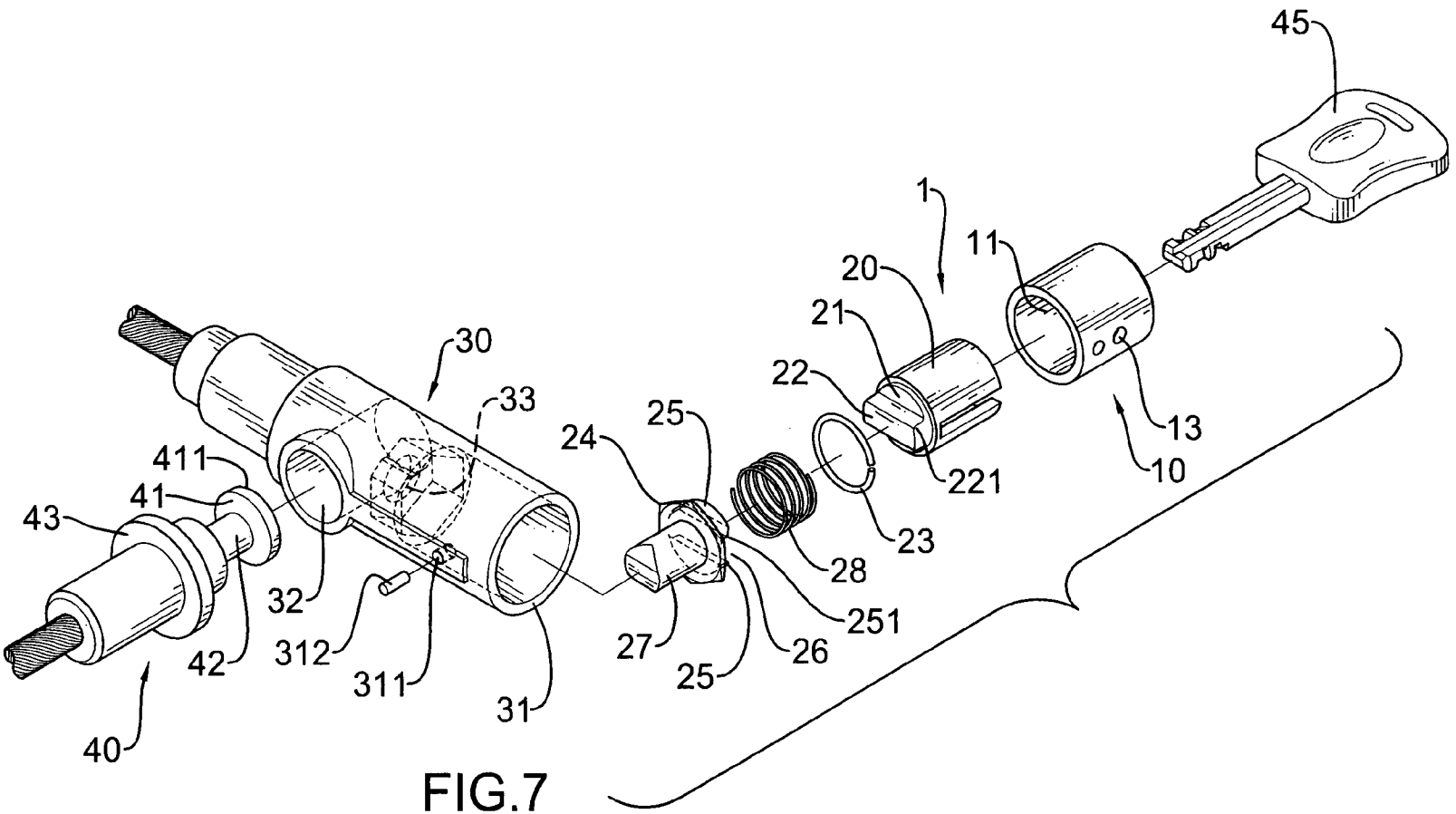
FIG. 7 is an exploded perspective view of still another embodiment of the present invention.
Figure 8:
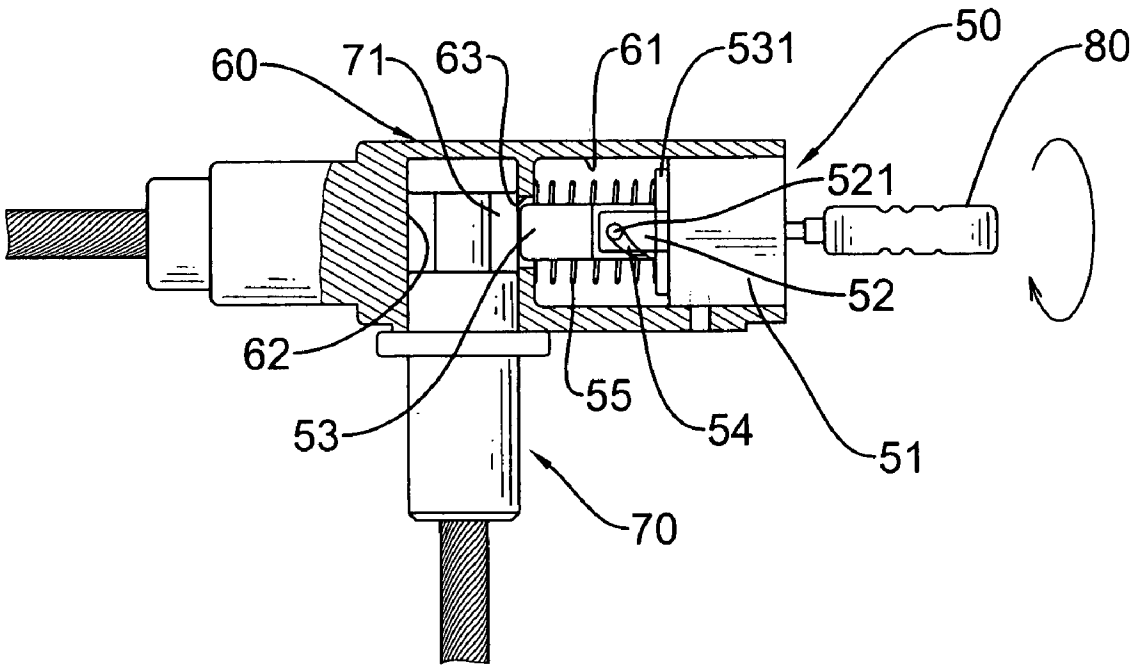
FIG.8 PRIOR ART
FIG. 8 is a side plan view in partial section of a conventional lock assembly in accordance with the prior art with the lock assembly unlocked.
Figure 9:
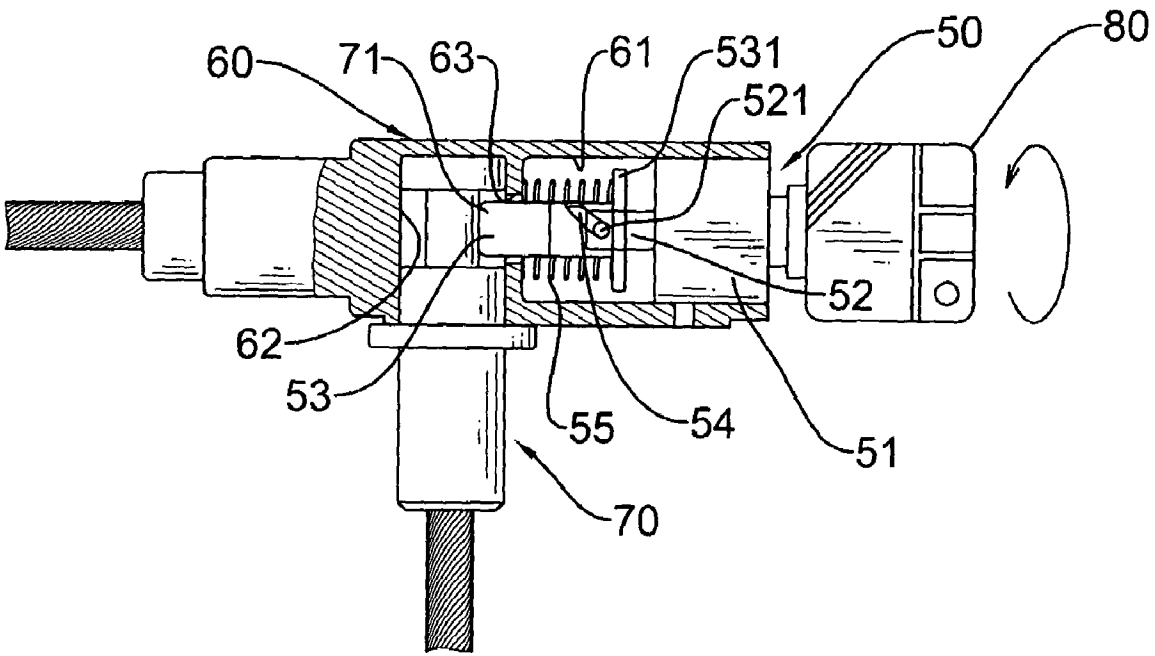
FIG.9 PRIOR ART
FIG. 9 is a plan view in partial section of the conventional lock assembly in FIG. 8 with the lock assembly locked.

With reference to FIG. 7, it is noted that the rotary bolt driver (20) is securely yet rotatably received in the cylinder assembly (10) with the crossbar (22) extending out of the open end (12). The latching disk (24) and the spring (28) are received in the longitudinal chamber (31). Furthermore, the inner face of the longitudinal chamber (31) is so configured that after the latching disk (24) is received in the longitudinal chamber (31) there is not relative rotational movement between the latching disk (24) and the casing (30). That is, the latching disk (24) can only have linear movement inside the longitudinal chamber (31).

Although the invention has been explained in relation to its preferred embodiment, many other possible modifications and variations especially with regard to size and shape can be made without departing from the spirit and scope of the invention as hereinafter claimed.

What is claimed is:

1. A lock assembly comprising:

a casing having a longitudinal chamber and a transverse chamber perpendicular to the longitudinal chamber and a bolt hole defined in the casing to communicate the longitudinal chamber with the transverse chamber;

a cylinder assembly mounted securely inside the longitudinal chamber and having a cylindrical space defined inside the cylinder assembly;

a rotary bolt driver rotatably received in the cylindrical space of the cylinder assembly and having a crossbar formed on an end face of the rotary bolt driver and extending out of the cylindrical space; and a latching disk linearly and movably received in the longitudinal chamber by the rotational movement of the rotary bolt driver and having a latch bolt extending through the bolt hole in the casing, wherein the latching disk and the longitudinal chamber are so configured that after the latching disk is received in the longitudinal chamber, the latching disk is able to move linearly inside the longitudinal chamber; and a shank having a head formed on a distal end of the shank and a recessed neck adjacent to the head to be selectively aligned with the bolt hole such that when the head is moved into the transverse chamber, the latch bolt is first forced to move toward the rotary bolt driver and after the recessed neck aligns with the latch bolt, the latch bolt is moved toward the recessed neck and when the rotary bolt driver is rotated to move the latching disk, the latching disk is forced to move linearly to secure the shank in the casing.

2. The lock assembly as claimed in claim 1, wherein the latching disk has two stop blocks formed on a free end of the latching disk and the rotary bolt driver has a crossbar formed on a free end face of the rotary bolt driver to be selectively received between the stop blocks and to abut the two stop blocks.

3. The lock assembly as claimed in claim 1 further comprising a spring sandwiched between the latching disk and the rotary bolt driver to provide a force to the latching disk.

4. The lock assembly as claimed in claim 2 further comprising a spring sandwiched between the latching disk and the rotary bolt driver to provide a force to the latching disk.

5. The lock assembly as claimed in claim 1 further comprising a spring mounted around the latch bolt and sandwiched between a bottom face defining the longitudinal chamber and a side face of the latching disk to provide a force to the latching disk.

6. The lock assembly as claimed in claim 2 further comprising a spring mounted around the latch bolt and sandwiched between a bottom face defining the longitudinal chamber and a side face of the latching disk to provide a force to the latching disk.

7. The lock assembly as claimed in claim 3, wherein a passage is defined between two stop blocks to selectively correspond to and receive therein a crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

8. The lock assembly as claimed in claim 4, wherein a passage is defined between the two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

9. The lock assembly as claimed in claim 5, wherein a passage is defined between two stop blocks to selectively correspond to and receive therein a crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

10. The lock assembly as claimed in claim 6, wherein a passage is defined between the two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

11. A lock assembly comprising:

a casing having a longitudinal chamber and a transverse chamber perpendicular to the longitudinal chamber and a bolt hole defined in the casing to communicate the longitudinal chamber with the transverse chamber;

a cylinder assembly mounted securely inside the longitudinal chamber and having a cylindrical space defined inside the cylinder assembly;

a rotary bolt driver rotatably received in the cylindrical space of the cylinder assembly and having a crossbar formed on an end face of the rotary bolt driver and extending out of the cylindrical space; and a latching disk linearly and movably received in the longitudinal chamber by the rotational movement of the rotary bolt driver and having a latch bolt extending through the bolt hole in the casing, wherein the latching disk and the cylindrical space are so configured that after the latching disk is received in cylindrical space, the latching disk is able to move linearly inside the cylindrical space; and a shank having a head formed on a distal end of the shank and a recessed neck adjacent to the head to be selectively aligned with the bolt hole such that when the head is moved into the transverse chamber, the latch bolt is first forced to move toward the rotary bolt driver and after the recessed neck aligns with the latch bolt, the latch bolt is moved toward the recessed neck and when the rotary bolt driver is rotated to move the latching disk, the latching disk is forced to move linearly to secure the shank in the casing.

12. The lock assembly as claimed in claim 11, wherein the latching disk has two stop blocks formed on a free end of the latching disk and the rotary bolt driver has the crossbar formed on a free end face of the rotary bolt driver to be selectively received between the stop blocks and to abut the two stop blocks.

13. The lock assembly as claimed in claim 11 further comprising a spring sandwiched between the latching disk and the rotary bolt driver to provide a force to the latching disk.

14. The lock assembly as claimed in claim 12 further comprising a spring sandwiched between the latching disk and the rotary bolt driver to provide a force to the latching disk.

15. The lock assembly as claimed in claim 11 further comprising a spring mounted around the latch bolt and sandwiched between a bottom face defining the longitudinal chamber and a side face of the latching disk to provide a force to the latching disk.

16. The lock assembly as claimed in claim 12 further comprising a spring mounted around the latch bolt and sandwiched between a bottom face defining the longitudinal chamber and a side face of the latching disk to provide a force to the latching disk.

17. The lock assembly as claimed in claim 13, wherein a passage is defined between two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

18. The lock assembly as claimed in claim 14, wherein a passage is defined between the two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

19. The lock assembly as claimed in claim 15, wherein a passage is defined between two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

20. The lock assembly as claimed in claim 16, wherein a passage is defined between the two stop blocks to selectively correspond to and receive therein the crossbar so that when the crossbar is received in the passage the latching disk is able to freely and linearly move inside the longitudinal chamber and when the rotary bolt driver is rotated to have the crossbar abut the stop blocks, the latching disk is secured inside the longitudinal chamber.

* * * * *